US007628435B1

(12) United States Patent
Golz

(10) Patent No.: US 7,628,435 B1
(45) Date of Patent: Dec. 8, 2009

(54) WEB SECTION, ROUND SLING MADE FROM THE WEB SECTION, AND METHOD OF MAKING THE ROUND SLING

(75) Inventor: Robert E. Golz, Swansea, MA (US)

(73) Assignee: Murdock Webbing Co., Inc., Centrall Falls, RI (US)

( * ) Notice: Subject to any disclaimer, the term of this patent is extended or adjusted under 35 U.S.C. 154(b) by 342 days.

(21) Appl. No.: 11/059,421

(22) Filed: Feb. 16, 2005

(51) Int. Cl.
*B66C 1/12* (2006.01)

(52) U.S. Cl. ..... 294/74

(58) Field of Classification Search ..... 294/74; 139/387 R, 388; 87/6, 29
See application file for complete search history.

(56) References Cited

U.S. PATENT DOCUMENTS

| | | | | |
|---|---|---|---|---|
| 1,373,457 | A | 4/1921 | Smith | |
| 1,475,859 | A | 11/1923 | Nyman | |
| 2,549,382 | A | 4/1951 | Mitterway | |
| 3,953,640 | A * | 4/1976 | Takada | 428/188 |
| 4,210,089 | A | 7/1980 | Lindahl | |
| 4,421,352 | A | 12/1983 | Raue et al. | |
| 4,735,035 | A | 4/1988 | Mattioli | |
| 4,843,807 | A | 7/1989 | von Danwitz | |
| 4,850,629 | A | 7/1989 | St. Germain | |
| 4,946,119 | A * | 8/1990 | Hellhake | 248/102 |
| 5,273,080 | A | 12/1993 | Morohashi et al. | |
| 5,402,832 | A * | 4/1995 | Kamper et al. | 139/387 R |
| 5,564,476 | A * | 10/1996 | Golz | 139/388 |
| 6,149,215 | A * | 11/2000 | Balogh et al. | 294/74 |
| 7,117,900 | B2 * | 10/2006 | Lam et al. | 139/421 |
| 2005/0093317 | A1 * | 5/2005 | Hess | 294/68.3 |

* cited by examiner

*Primary Examiner*—Paul T Chin
(74) *Attorney, Agent, or Firm*—Salter & Michaelson

(57) ABSTRACT

A web section and a round sling constructed from the web section. The web section includes elasticized weft yarns that facilitate an improved method of constructing the round sling. The round sling includes inner and outer jackets and a plurality of load bearing yarns.

22 Claims, 6 Drawing Sheets

WEB SECTION, ROUND SLING MADE FROM THE WEB SECTION, AND METHOD OF MAKING THE ROUND SLING

BACKGROUND

1. Technical Field

The present application is directed to a web section, a round sling constructed from the web section, and methods of making the same and, more particularly, to a web section including elasticized weft strands, a round sling constructed from the web section, and methods of making the same.

2. Related Art

Round slings (also known in the art sometimes as endless or circular slings, or endless spools) are used in a variety of industries for lifting and/or protecting objects, for example, for lifting and protecting nuclear fuel rods during transfer from one location to another.

Simple round slings may be constructed by sewing the ends of a length of material together to form a loop.

More complex round slings may be formed from tubular web sections, the ends of which have been attached, typically by sewing. The tubular webs may be woven as a tube, or may be formed from a planar webbing that is sewn together longitudinally to form a tubular web, as disclosed in U.S. Pat. No. 1,373,457 to Smith. The web sections from which the round slings are formed are typically stiff and inflexible in order to meet the strength requirements of the round slings and to prevent stretching in the axial direction.

Round slings that are used for lifting or weight bearing sometimes may include a load bearing material inside a tubular web. The load bearing material is typically a material that increases the ability of the sling to withstand greater loads.

During use, round slings may be rubbed against other objects, which may cause wear to the web and in some instances may tear the web and/or load bearing material, thereby reducing the strength of the sling as well as its longevity. In such instances, 'jackets' have been added to the round slings. Such jackets are simply a second tubular web into which the first tubular web and/or load bearing material is inserted or woven together. If desired, the outer tubular web may be made more abrasion resistant by using a particular weave or yarn or by coating a portion of or the entire outer surface of the outer tubular web to make the outer surface rougher.

A typical construction technique for forming double-jacketed round slings involves inserting the inner tubular web section into the outer tubular web followed by inserting a load bearing material into the inner tubular web. The ends of the inner tubular web and outer tubular web are then attached together in succession, preferably by sewing. This type of construction causes concern with regard to the rupture of the seams or stitches when they engage or are bearing against the sling.

U.S. Pat. No. 4,210,089 to Lindahl discloses a lifting sling that includes a single inner core which is divided or spaced apart from itself inside of a protective cover which has its edges connected by a seam which penetrates diametrically through the sling core material. This sling suffers in practical usefulness because it is only a single core and has no safety backup core in case there is damage to or a defect in the single core which reduces the load lifting capacity of the sling, or indeed, which renders it totally useless.

In order to attach or sew the components of the round sling together, it is necessary to expose the underlying load bearing material or web by pushing or folding back the ends of the web sections. In practice, this is very difficult because the tubular webs are generally quite thick and/or stiff. When outer jackets are used, the difficulties are exacerbated, especially if the weave used is less flexible than the inner tubular web, or if it includes an abrasion resistant coating. Thus, the lack of pliability of the webs makes pushing and folding or unfolding the webs particularly difficult, thereby increasing manufacturing time. In addition, the narrower the tubular web, the less pliable the tubular web.

The patent literature provides many examples of attempts to improve the construction of round slings. For example, U.S. Pat. No. 4,843,807 to von Danwitz discloses a method of producing an endless spool that involves using two tubular linked sections as the outer jacket of the sling, which maybe overlapped to expose the underlying section for attachment. U.S. Pat. No. 4,850,629 to St. Germain discloses a sling that includes multiple discrete sling cores which are each contained inside separate cover material to prevent contact between the sling cores. The core material comprises a length of high tensile material that is in an endless loop within each core. U.S. Pat. No. 5,402,832 to Kämper et al. discloses an endless sling in which a plurality of binding elements are positioned between two webs to connect them through a variety of chambers.

A need exists in the art for an improved web section that facilitates an improved method of making a round sling, without sacrificing tensile strength.

SUMMARY

In accordance with the present invention there is provided a round sling, comprising: a first tubular web section having a selected length and first and second attached ends, the first tubular web section including a plurality of elasticized weft strands. The round sling may further comprise at least one strand of a load bearing material disposed coaxially in the first tubular web section, the load bearing material having a predetermined tensile strength. The round sling may further comprise a second tubular web section, the first tubular web section being disposed coaxially in the second tubular web section, the second tubular web section having a selected length and first and second attached ends and including a plurality of elasticized weft strands. The round sling has a predetermined load bearing capacity determined at least in part by the tensile strength of the at least one strand of load bearing material. The round sling has its load bearing capacity further determined at least in part by the quantity of strands of the at least one strand of load bearing material. The at least one strand of load bearing material may be a plurality of strands of load bearing material. The plurality of strands of load bearing material may be high tenacity continuous filament yarns. The first tubular web section may be woven using a weave selected from the group consisting of a single wall, double wall or triple wall, and combinations thereof. The first tubular web section may be woven with a plain weave. The elasticized weft strands are selected from the group consisting of monofilament polymers, neoprene, latex, spandex, covered spandex, and covered and uncovered combinations thereof. The elasticized weft strands may be spandex with spun polyester top and bottom covers. The warp strands may be selected from the group consisting of nylon, polyester, nomex, kevlar, spectra, vectran, dyneema, tauron, or any yarn like material, and combinations thereof. The warp strands may be textured nylon, textured polyester, and combinations thereof. The at least one strand of load bearing material may have a selected length substantially different from the length of the first tubular web section. The web section may have an elasticity of at least 5%. And preferably in a range of 5% to 50%.

In accordance with another aspect of the present invention there is provided a method for constructing a round sling, comprising the steps of: forming a first tubular web section having a selected length and opposing ends, the first tubular web section including a plurality of elasticized weft strands; and attaching the opposing ends of the first tubular web section to one another. The method may further comprise the step of: before the step of attaching the opposing ends of the first tubular web section together, positioning at least one strand of a load bearing material coaxially in the first tubular web section, the at least one strand of load bearing material having opposing ends; and attaching the opposing ends of the at least one strand of load bearing material together; wherein the at least one strand of load bearing material has a predetermined tensile strength. The method may further comprise the steps of: before the step of attaching the opposing ends of the at least one load bearing strand, radially expanding the first tubular web section and at least partially exposing the at least one load bearing strand. The method may further comprise the steps of: before the steps of attaching the opposing ends of the at least one load bearing strand together and attaching the opposing ends of the first tubular web section together, forming a second tubular web section having a selected length and first and second opposing ends, the second tubular web section including a plurality of elasticized weft strands; positioning the first tubular web section coaxially in the second tubular web section; and after the step of attaching the opposing ends of the first tubular web section together, attaching the opposing ends of the second tubular web section together. The method may further comprise the steps of: radially expanding the second tubular web section and at least partially exposing the at least one load bearing strand and the first tubular web section.

In accordance with still a further aspect of the present invention there is provided a tubular web section comprising a plurality of elasticized weft strands alternating with a plurality of substantially inelastic warp strands, the tubular web section having an inner surface and an outer surface. The tubular web section may be woven using a weave selected from the group consisting of single wall, double wall or triple wall, and combinations thereof. The tubular web section may be woven with a plain weave. The elasticized weft strands may be selected from the group consisting of monofilament polymers, neoprene, latex, spandex, either uncovered or covered, and combinations thereof. The elasticized weft strands may be spandex covered with spun polyester top and bottom covers. The warp strands may be selected from the group consisting of nylon, polyester, nomex, kevlar, spectra, vectran, dyneema, tawaron, or any yarn like material and combinations thereof. The warp strands may be texturized or continuous filament nylon or polyester or combinations thereof. The tubular web section may further comprise a coating on the outer surface. The coating on the outer surface may be selected from the group consisting of a resin coating, a latex coating, a UV inhibitor coating, and combinations thereof. The tubular web section may further comprise a coating on the inner surface.

The foregoing and other objects, features and advantages of the disclosure will be apparent from the following more particular description of preferred embodiments of the disclosure, as illustrated in the accompanying drawings in which like reference characters refer to the same parts throughout the different views. The drawings are not necessarily to scale, emphasis instead being placed upon illustrating the principles of the disclosure. The principles and features of this disclosure may be employed in varied and numerous embodiments without departing from the scope of the disclosure.

DETAILED DESCRIPTION OF THE PREFERRED EMBODIMENTS

The present disclosure is directed to a radially expandable web section that may be pushed and/or folded with ease, and that facilitates an improved method of constructing round slings.

An exemplary web section according to the disclosure is preferably tubular, and includes elasticized weft strands and substantially inelastic warp strands. Because the weft strands are elasticized, the tubular web section maybe expanded or stretched in one direction, and it will return to its original diameter upon release. The terms "warp" and "weft," as used herein, are used according to their generally understood meanings. That is, warp strands are those that are stretched lengthwise in a loom, and weft threads are those that are woven across the warp threads to make a fabric.

Another aspect of the disclosure is a round sling that includes or is formed from at least one of the foregoing tubular web sections. In preferred embodiments, the round slings include at least one load bearing material positioned coaxially therein.

Figure 1:
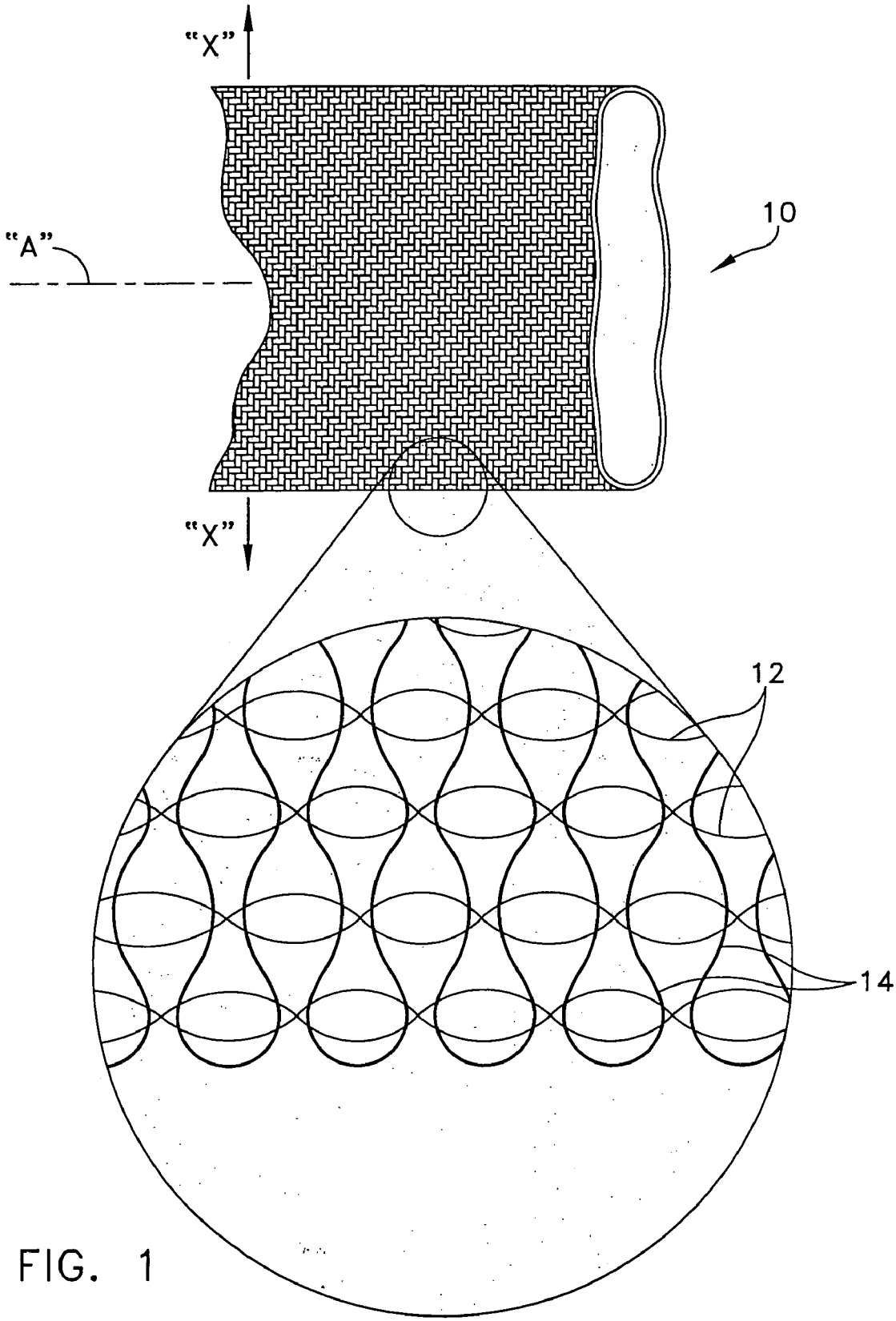
FIG. 1 is an expanded view of a portion of an exemplary web section according to the present disclosure.

FIG. 1 illustrates a web section 10 according to the present disclosure. As shown, web section 10 preferably has a tubular construction with a longitudinal centerline or axis "A." Web section 10 may be woven with longitudinal warp strands 12 alternating with transverse weft strands 14. Preferably, web section 10 is woven using a plain weave, double plain weave, triple plain weave, or combinations of the foregoing weaves. The elasticized weft strands 14 allow the diameter of tubular web section 10 to be expanded or stretched in the direction indicated by arrows "X," and to return to its original diameter upon release.

In preferred embodiments, some or all of weft strands 14 may be formed from an elasticized material. One type of yarn that has been found suitable is continuous filament 1000/2 denier polyester and 2850/1 denier texturized nylon.

In preferred embodiments, some or all of warp strands 12 may be formed from a substantially inelastic material. In the present exemplary embodiment, each weft strand 14 is formed from an elasticized material, and each warp strand 12 is formed from a substantially inelastic material.

"Elasticized material," as used herein, means any woven or non-woven material that will return to substantially its original shape after deformation. Those of skill in the art will be able to select many suitable materials for the weft strands, which are available in a variety of tensile strengths from a variety of manufacturers. Thus, the degree of radial expansion of web section 10 in direction "X" may be varied by varying the quantity, size, material and constructions from which the weft strands are formed. For example, covering the elasticized material with textile yarns may change or limit its stretch characteristics.

As indicated previously the weft strands 14 are formed of an elastic or elasticized material. These strands are selected so that the final web section preferably has an elasticity at a minimum of 5%. This represents the percentage amount that the web section can be stretched in the "X" direction. In other words for a given width of section, with an elasticity of 5%, the web can be stretched 5% of that given amount. The preferred range of elasticity is 5% to 50%.

The weft strands 14 may be formed from an elasticized material that selected from the group consisting of monofilament polymers, neoprene, lycra, latex, spandex, covered spandex, and combinations thereof. In one embodiment the main strand is spandex covered with a single spin polyester. The covering or wrapping can include a bottom wrap in the S-direction and a top wrap in the Z-direction so as to prevent kinking.

As noted above, warp strands 12 are preferably substantially inelastic. Those of skill in the art will be able to select many suitable materials for the warp strands, which are available in a variety of tensile strengths from a variety of manufacturers. The warp strands 12 may be a textured nylon or other continuous filament polyester or polypropylene strand. Thus, web section 10 is constructed to provide a predetermined tensile strength in the longitudinal or axial direction while providing flexibility and stretching in direction "X."

The tensile strength and/or elasticity of the web section also may be varied by changing the material or the weave of the web section.

Thus, one aspect of the present disclosure is a web section that is expandable from a first diameter to a second diameter upon stretching, which will return to its original or first diameter upon release of the stretching force, and which may not stretch substantially in the longitudinal or axial direction "A."

Figure 2:
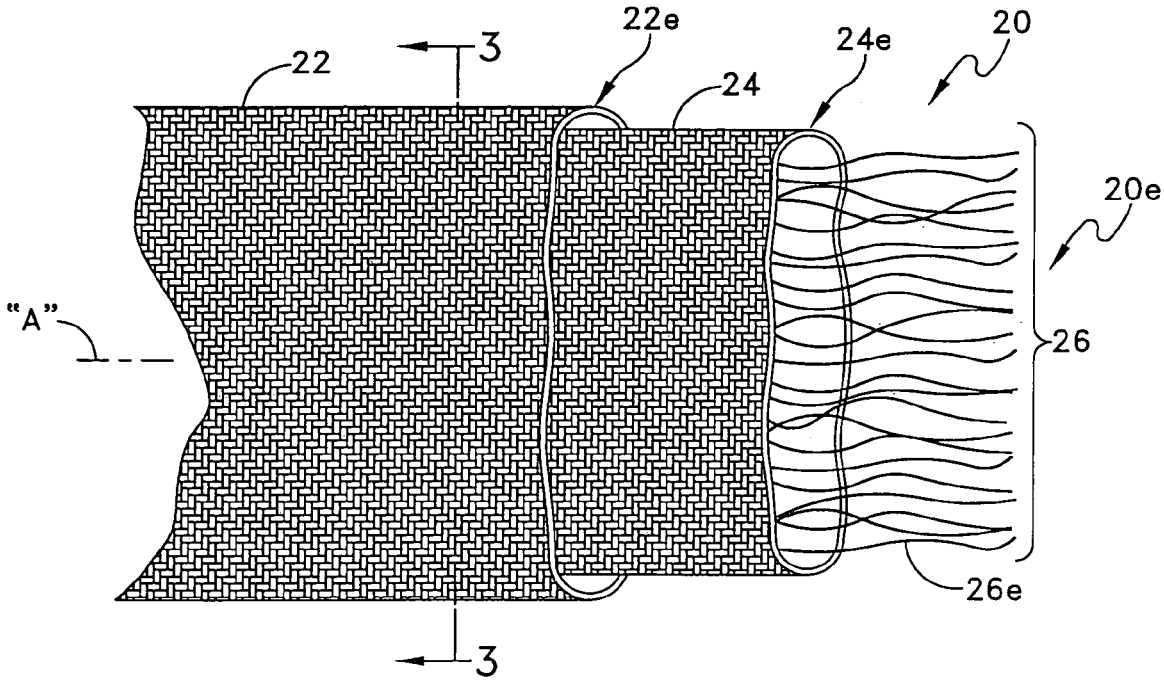
FIG. 2 is a side view of an exemplary round sling constructed from the web section shown in FIG. 1, showing an inner tubular web section, an outer tubular web section, and a plurality of load bearing strands.
Figure 3:
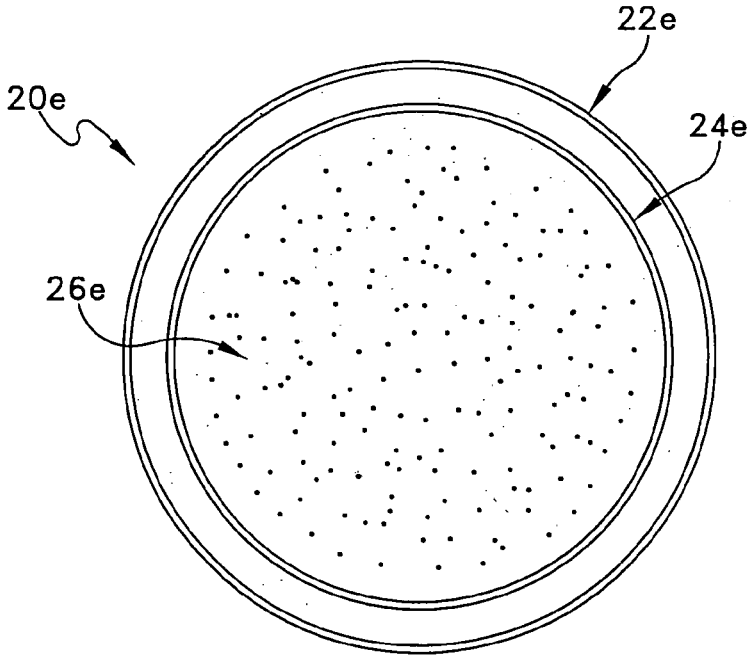
FIG. 3 is a cross-sectional view of the round sling shown in FIG. 2 as taken along line 3-3.

As discussed previously, web sections according to the present disclosure may be used in the manufacture of a variety of items, including single and double-walled round slings. FIGS. 2 and 3 show a preferred embodiment of a section of an exemplary double-walled round sling 20 according to the present disclosure. Round sling 20 is preferably symmetrical and includes an outer tubular web section 22 having opposing ends 22*e* and an inner tubular web section 24 having opposing ends 24*e*. In general, web sections 22,24 each have substantially the same length, but this is not required, and there may be situations in which it is desirable or necessary for the lengths to be different. Inner tubular web section 24 is preferably positioned coaxially in outer tubular web section 22.

Preferably, both inner and outer tubular web sections 22, 24 are constructed in the same manner as web section 10 (FIG. 1). That is, inner and outer tubular web sections 22,24 each preferably include longitudinal warp strands 12 alternating with transverse weft strands 14, with some or all of weft strands 14 being formed from an elasticized material, and some or all of warp strands 12 being formed from a substantially inelastic material.

Round sling 20 may include at least one strand 26 of load bearing material positioned coaxially within inner tubular web section 24. Load bearing strand 26 preferably has substantially the same length as inner and outer tubular web sections 22,24, but this is not required, and there may be situations in which it is desirable or necessary for its length to be different than one or both of inner and outer tubular web sections 22,24. The quantity and tensile strength of the load bearing strand 26 positioned in inner tubular web section 24 determines, at least in part, the tensile and break strength of round sling 20. Thus, the tensile/breaking strength of round sling 10 may be varied by varying the type and quantity of strands 26 of load bearing material. As shown, the present embodiment includes a plurality of load bearing strands 26, each having a predetermined tensile/breaking strength. It is possible that a single length of material other than a strand may be positioned coaxially in inner tubular web section 24 provided that round sling 20 meets the design requirements for tensile/breaking strength. Other materials may be used, provided that they have sufficient tensile strength to meet the design requirements of round sling 20. In preferred embodiments, load bearing strands 26 are high tenacity continuous filament yarns (hereinafter polyester), which is available in a variety of tensile strengths and from a variety of manufacturers. When a yarn such as polyester is used for the at least one load bearing material, the tensile/breaking strength of the round sling 10 may be varied by varying the type and quantity of strands 26.

The tensile/breaking strength of round sling 20 also may be varied by varying the material or the weave from which inner and outer webs 22,24 are formed.

Thus, another aspect of the present disclosure is an improved round sling having tubular web sections that are radially and elastically expandable and which may not stretch substantially in the longitudinal or axial direction "A."

Figure 4:
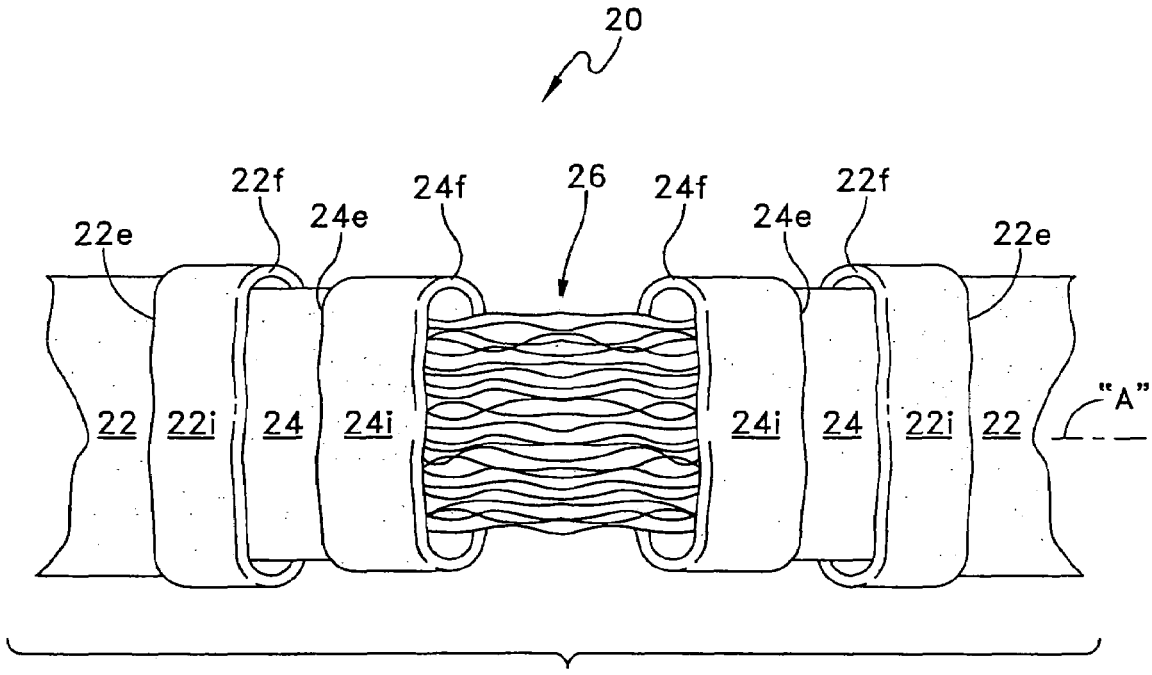
FIG. 4 shows the round sling shown in FIGS. 2 and 3 prior to attachment of the webbing jackets.

An improved method for constructing round sling 20 will now be described with reference to FIGS. 4-8, which method is facilitated by the particular construction of inner and outer tubular web sections 22,24. FIG. 4 shows round sling 20 with a plurality of load bearing strands 26 disposed in inner tubular web section 24, and with inner tubular web section 24 disposed in outer tubular web section 22, prior to attachment of ends 22*e*, 24*e*. As shown, prior to attachment of ends 22*e* of web section 22, section 22 may be folded back at fold 22*f* to expose inner tubular web 24. Thereafter, ends 24*e* of inner tubular web 24 may be folded back at fold 24*f* to expose load bearing strands 26. Even though the present method is illustrated with the formation of folds 22*f*,24*f*, it should be understood that the method also may be practiced by pushing back ends 22*e*,24*e* without necessarily requiring the formation of a fold. However, for ease of explanation, the method will be described using a folding technique. The amount of folding or pushing back will be determined on a case by case basis, but at a minimum should be sufficient to expose a sufficient length of load bearing strands 26.

Figure 5:
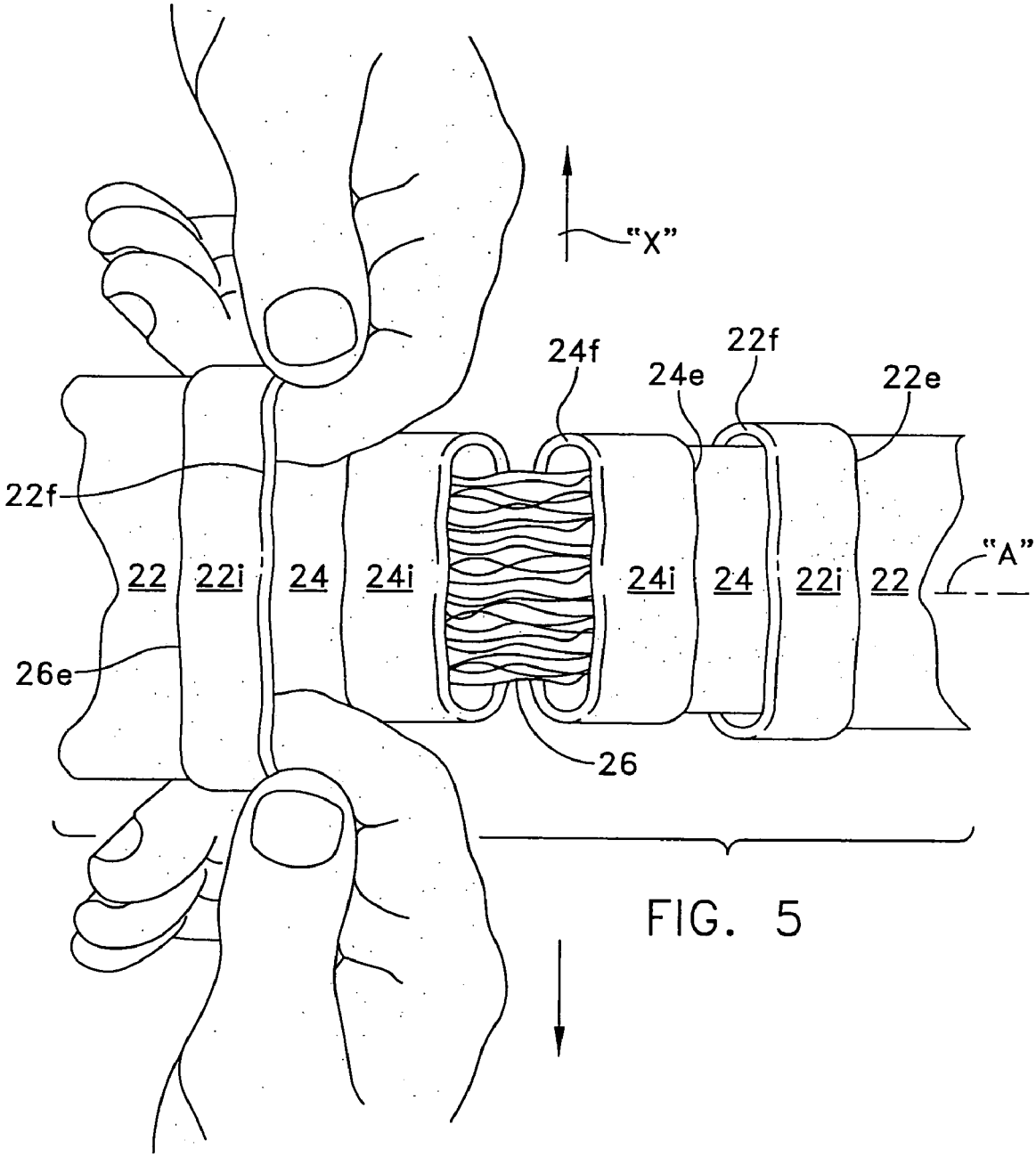
FIG. 5 shows the round sling illustrated of FIG. 4 showing the manual expansion of the tubular web section in the radial direction indicated by the arrows.

As shown in FIG. 5, in practicing the present method, the formation of folds 22*f*, 24*f* is facilitated by the pliability of inner and outer tubular web sections 22,24, which stretch radially in the direction indicated by arrows "X." Such radial stretching cannot be accomplished with other types of web sections, but may be accomplished with relative ease in the present method due to the elasticized weft strands 14. Thus, the elasticized weft strands 14 increase the pliability of web sections 22,24, allowing them to be stretched or expanded in a radial direction for ease of folding and unfolding and/or pushing. Moreover, the radial expansion of web sections 22,24 allows greater exposure of load bearing strands 26 than might otherwise be achieved when inelastic weft strands are used, as is typical in conventional round sling construction. The improved exposure of underlying strands 26 reduces construction time without sacrificing the strength of round sling 10 in the axial direction "A."

Figure 6:
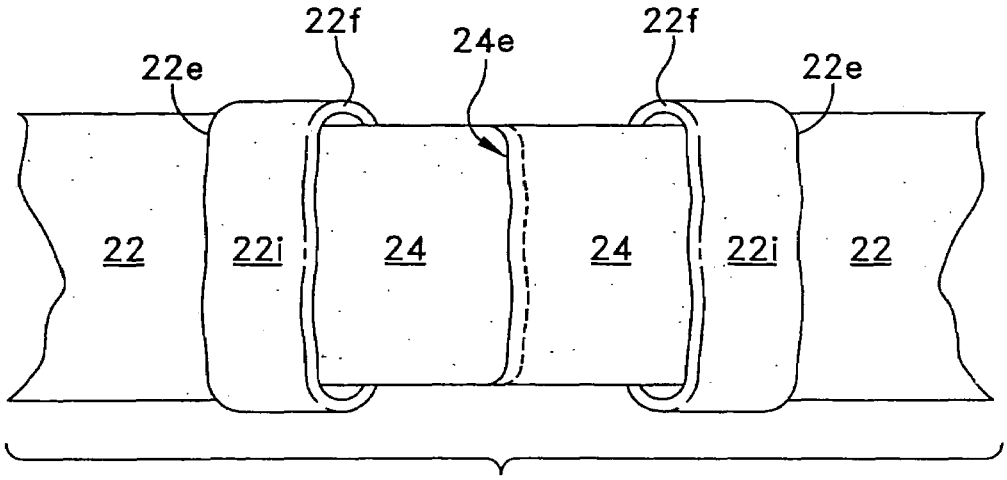
FIG. 6 shows the round sling of FIG. 5 after the ends of the inner tubular web section have been attached to one another.

As shown in FIG. 6, folds 24*f* of inner tubular web section 24 may be unfolded, and ends 24*e* may be attached, again preferably by sewing. If desired or necessary to obtain greater exposure of inner tubular web section 24 in order to facilitate attachment of ends 24*e*, outer tubular web section 24 may be folded back to a greater degree, or alternatively folded repeatedly back upon itself to from a plurality of folds 24*f*. Again, the attachment of respective ends 24*e* of inner tubular web section 24 may be carried out with relative ease because ends 22*e* of outer tubular web section 22 are out of the way and do not interfere with the attachment step of the inner web section.

Figure 7:
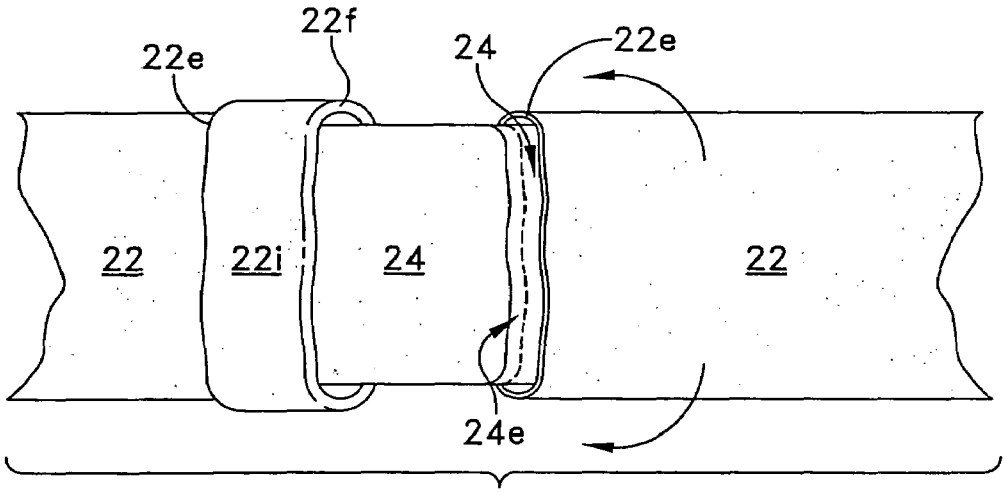
FIG. 7 shows the round sling of FIG. 6 after one end of the outer tubular web section has been unfolded.
Figure 8:
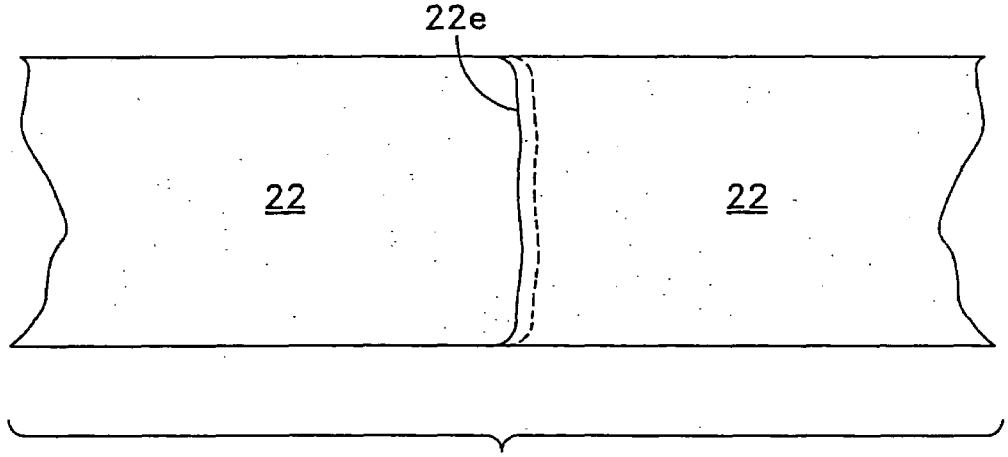
FIG. 8 shows the round sling of FIG. 7 after the ends of the outer tubular web sections have been attached to one another.

Finally, after attachment of ends 24*e* of inner tubular web section 24, folds 22*f* of outer tubular web section 22 may be unfolded as shown in FIG. 7, and thereafter attached together as shown in FIG. 8, again preferably by sewing.

Thus, another aspect of the present disclosure is an improved method of constructing a round sling from a tubular web section with elasticized weft strands, which facilitates ease of construction and reduces construction time, without sacrificing the tensile strength of the round sling.

Figure 9:
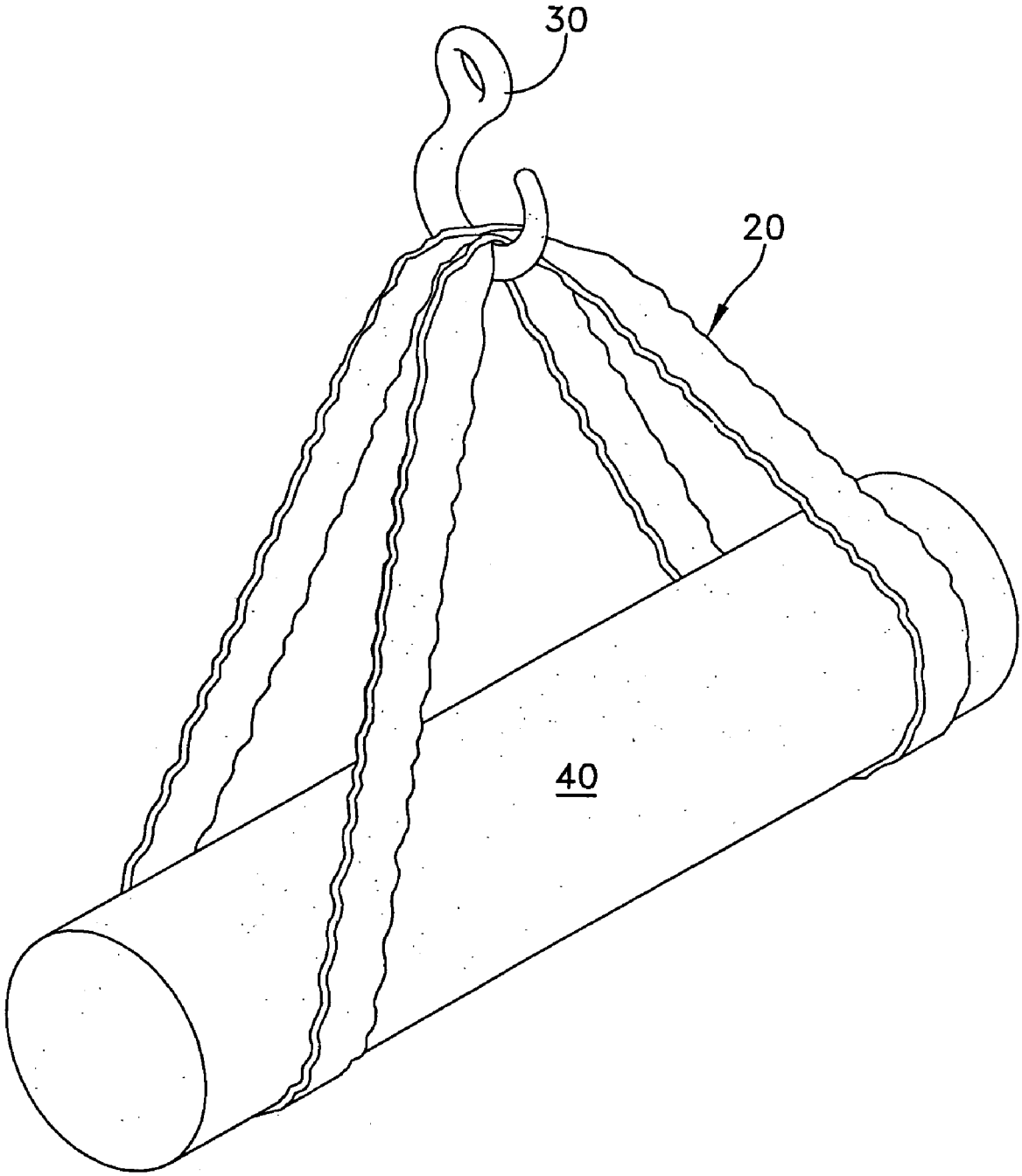
FIG. 9 is a perspective view of the round sling shown in FIGS. 2-8 in use, being suspended from a hook, and with an object supported therein.

FIG. 9 shows a round sling 20 according to the disclosure being used in a customary manner. As shown, round sling 20 is suspended from a hook 30 and supports, for example, a cylindrical object 40.

If desired, the interior and/or exterior surfaces of inner and outer tubular web sections 22,24 may be coated in whole or in part with a suitable coating material (not illustrated), selected for its desired effect. For example, it may be desirable to reduce the friction between inner and outer tubular web sections 22,24. Therefore, a coating such as resin, UV or might be desirable on the outer surface of inner tubular web section 22, the inner surface of outer tubular web section 24, or both. In some instances it also may be desirable to increase the friction between the outer surface of outer tubular web section 24 and hook 30 or object 40. In such instances, a coating such as latex might be desirable on the outer surface of outer tubular web section 24, in order to minimize slipping or sliding.

While this disclosure has been particularly shown and described with references to preferred embodiments thereof, it will be understood by those skilled in the art that various changes in form and details may be made therein without departing from the spirit and scope of the disclosure as defined by the appended claims. For example, there has been described herein a sling construction that employs basically two web sections. It is understood that, in accordance with the present invention, there may be provided only one web section or a sling embodying three or more web sections, each preferably characterized by an expansion in the "X" direction.

What is claimed is:

1. A round sling, comprising:

a first tubular web section having a selected length and first and second ends;

said first tubular web section including a plurality of elasticized weft strands and a plurality of substantially inelastic warp strands;

a second tubular web section, the first tubular web section being of smaller diameter than the diameter of the second tubular web section and disposed coaxially in the second tubular web section;

said second tubular web section having a selected length and first and second ends;

said second tubular web section also including a plurality of elasticized weft strands and a plurality of substantially inelastic warp strands;

the elasticized weft strands of the second tubular web section being radially and elastically expandable to enable the diameter of the second tubular web section to expand in a direction transverse to a longitudinal axis of the second tubular web section length so as to enable exposure of and ready attachment between the first and second ends of the first tubular web section;

at least one strand of a load bearing material disposed coaxially in the first tubular web section, the load bearing material having a predetermined tensile strength.

2. The round sling of claim 1 wherein the elasticized weft strands of the second tubular web section are disposed from first end to second end of the second tubular web section.

3. The round sling of claim 1 wherein each tubular web section is woven using a weave selected from the group consisting of plain weave, double plain weave, triple plain weave, or combinations thereof.

4. The round sling of claim 1 wherein the elasticized weft strands are selected from the group consisting of monofilament polymers, neoprene, latex, spandex, either uncovered or covered, and combinations thereof.

5. The round sling of claim 1 wherein the warp strands are selected from the group consisting of nylon, polyester, nomex, kevlar, spectra, vectran, dyneema, tauron, or any yarn like material and combinations thereof.

6. The round sling of claim 1 including a coating on at least one of the tubular web sections and selected from the group consisting of a resin coating, a latex coating, a UV inhibitor coating, and combinations thereof.

7. The round sling of claim 1 wherein each tubular web section has an elasticity in a range of 5% to 50%.

8. A round sling, comprising:

an inner tubular web section having a selected length and first and second ends;

the inner tubular web section including a plurality of elasticized weft strands and a plurality of substantially inelastic warp strands;

an outer tubular web section, the inner tubular web section being disposed coaxially in the outer tubular web section;

the outer tubular web section having a selected length and first and second ends;

the outer tubular web section also including a plurality of elasticized weft strands and a plurality of substantially inelastic warp strands;

the elasticized weft strands of the outer tubular web section being radially and elastically expandable to enable the diameter of the of the outer tubular web section to expand in a X direction transverse to a longitudinal axis A of the outer tubular web section length so as to enable exposure of and ready attachment between the first and second ends of the inner tubular web section.

9. The round sling of claim 8 wherein at least one strand of a load bearing material is disposed coaxially in the inner tubular web section, the load bearing material having a predetermined tensile strength.

10. The round sling of claim 8 wherein the elasticized weft strands of the outer tubular web section are disposed from first end to second end of the outer tubular web section.

11. The round sling of claim 8 wherein each tubular web section is woven using a weave selected from the group consisting of plain weave, double plain weave, triple plain weave, or combinations thereof.

12. The round sling of claim 8 wherein the elasticized weft strands are selected from the group consisting of monofilament polymers, neoprene, latex, spandex, either uncovered or covered, and combinations thereof.

13. The round sling of claim 8 wherein the warp strands are selected from the group consisting of nylon, polyester, nomex, kevlar, spectra, vectran, dyneema, tauron, or any yarn like material and combinations thereof.

14. The round sling of claim 8 including a coating on at least one of the tubular web sections and selected from the group consisting of a resin coating, a latex coating, a UV inhibitor coating, and combinations thereof.

15. The round sling of claim 8 wherein each tubular web section has an elasticity in a range of 5% to 50%.

16. A round sling, comprising:

an inner tubular web section having a selected length and first and second ends;

the inner tubular web section including a plurality of weft strands and a plurality of warp strands;

the weft and warp strands of the inner tubular web section together forming a woven inner tubular web section;

an outer tubular web section, the inner tubular web section being of a smaller diameter than the diameter of the outer tubular web section and disposed coaxially within the outer tubular web section;

the outer tubular web section having a selected length and first and second ends;

the outer tubular web section including a plurality of elasticized weft strands and a plurality of substantially inelastic warp strands;

the elasticizes weft and substantially inelastic warp strands together forming a woven outer tubular web section;

the elasticized weft strands of the outer tubular web section being radially and elastically expandable to enable the diameter of the of the outer tubular web section to expand in a X direction transverse to a longitudinal axis A of the outer tubular web section length so as to enable exposure of and ready attachment between the first and second ends of the inner tubular web section;

and a plurality of strands of a load bearing material that is disposed coaxially within the inner tubular web section, the load bearing material having a predetermined tensile strength.

17. The round sling of claim 16 wherein the elasticized weft strands of the outer tubular web section are disposed from first end to second end of the outer tubular web section.

18. The round sling of claim 16 wherein each tubular web section is woven using a weave selected from the group consisting of plain weave, double plain weave, triple plain weave, or combinations thereof.

19. The round sling of claim 16 wherein the elasticized weft strands are selected from the group consisting of monofilament polymers, neoprene, latex, spandex, either uncovered or covered, and combinations thereof.

20. The round sling of claim 16 wherein the warp strands are selected from the group consisting of nylon, polyester, nomex, kevlar, spectra, vectran, dyneema, tauron, or any yarn like material and combinations thereof.

21. The round sling of claim 16 including a coating on at least one of the tubular web sections and selected from the group consisting of a resin coating, a latex coating, a UV inhibitor coating, and combinations thereof.

22. The round sling of claim 16 wherein each tubular web section has an elasticity in a range of 5% to 50%.

* * * * *